United States Patent [19]

Juillet

[11] Patent Number: 4,687,119

[45] Date of Patent: Aug. 18, 1987

[54] DISPENSER FOR HOT AND COLD PRODUCTS

[76] Inventor: Hubert Juillet, 8, Place des Philosophes, 1205 Geneve, Switzerland

[21] Appl. No.: 793,319

[22] Filed: Oct. 23, 1985

[51] Int. Cl.[4] ..... A47F 1/04

[52] U.S. Cl. ..... 221/101; 221/76; 221/124; 221/133; 221/150 HC; 221/225; 221/253; 221/262

[58] Field of Search ..... 221/150 R, 150 HC, 150 A, 221/92, 97, 101, 133, 224, 225, 76, 77, 82, 84, 85, 123, 124, 253, 262; 99/357

[56] References Cited

U.S. PATENT DOCUMENTS

| | | | |
|---|---|---|---|
| 2,785,623 | 3/1957 | Graham | 221/150 A |
| 3,333,666 | 8/1967 | Murray et al. | 221/150 HC |
| 3,397,817 | 8/1968 | Smith | 221/150 HC |
| 3,482,509 | 12/1969 | Gardner | 221/150 HC |
| 3,620,341 | 11/1971 | Gardner | 221/150 HC X |
| 4,108,333 | 12/1976 | Falk et al. | 221/85 X |
| 4,125,205 | 11/1978 | Ambroise | 221/150 HC X |
| 4,519,523 | 5/1985 | Ohba et al. | 221/253 X |

FOREIGN PATENT DOCUMENTS

| | | | |
|---|---|---|---|
| 672794 | 11/1965 | Belgium | 221/77 |
| 572991 | 3/1933 | Fed. Rep. of Germany | 221/123 |
| 1171658 | 6/1964 | Fed. Rep. of Germany | 221/123 |
| 1474748 | 5/1969 | Fed. Rep. of Germany | 221/92 |
| 661860 | 11/1951 | United Kingdom | 221/150 R |

*Primary Examiner*—Robert J. Spar
*Assistant Examiner*—P. McCoy Smith
*Attorney, Agent, or Firm*—Robert E. Burns; Emmanuel J. Lobato

[57] ABSTRACT

An automatic dispenser for hot and cold food products comprises an isothermal cabinet in which a plurality of horizontal conveyor belts arranged one above another comprises a plurality of conveyor belts on which the food products are stored and a single delivery conveyor belt leading to a delivery opening in the cabinet. A microwave oven disposed in the cabinet above the horizontal conveyor belts has a door and a small conveyor belt inside. A lift comprising a small conveyor belt on vertically movable frame is provided adjacent vertically aligned ends of the horizontal conveyor belts and oven conveyor belt. The conveyor belts, oven and lift are controlled by a computerized control system in the manner that if a customer selects a product to be eaten hot, the product is transported to the oven, heated and transported to the delivery opening. If a customer selects a product to be eaten cold, the product is transported to the delivery opening without going to the oven.

4 Claims, 4 Drawing Figures

DISPENSER FOR HOT AND COLD PRODUCTS

The object of the present invention is an automatic dispenser for hot and/or cold products, comprising an isothermal cabinet wherein are arranged superposed conveyor belts, on each of which the products are disposed in a row, possibly within packaging receptacles, the corresponding ends of such conveyor belts being, at least on one side, vertically aligned, at least one oven disposed over said conveyor belts; cooling means for said cabinet; a lift comprising a conveyor belt of which one end moves in front of said aligned ends of said conveyor belts up to the level of said oven; means for introducing the products to be reheated in said oven; means for carrying the heated products and the products to be eaten cold towards an opening where they are at the consumer's disposal; means for controlling, before and after pre-payment for a product selected amongst the offered products, suitable displacements of said conveyor belts and of said lift so that the selected product is transported from its storage location, and according to whether the product should be reheated, first into the oven and then, once heated, to the outlet opening or, if the product is to be eaten cold, directly to the outlet opening.

Said dispenser is characterized in that said means for introducing the products to be reheated into said oven comprise a conveyor belt contained entirely in the heating enclosure of the oven, and in that said means for carrying the products, either hot or cold, towards the outlet opening comprise an output conveyor belt, one end of said two conveyor belts being as well vertically aligned with the aligned ends of the conveyor belts whereon the products are disposed, so that the products to be heated are carried from the lift into the oven, then, when heated, from said oven towards the outlet opening via the lift on the conveyor belts and the products to be eaten cold are carried directly towards the outlet opening via the lift, on the conveyor belts.

The enclosed exemplary drawing represents schematically an embodiment of the object of the invention.

Figure 1:
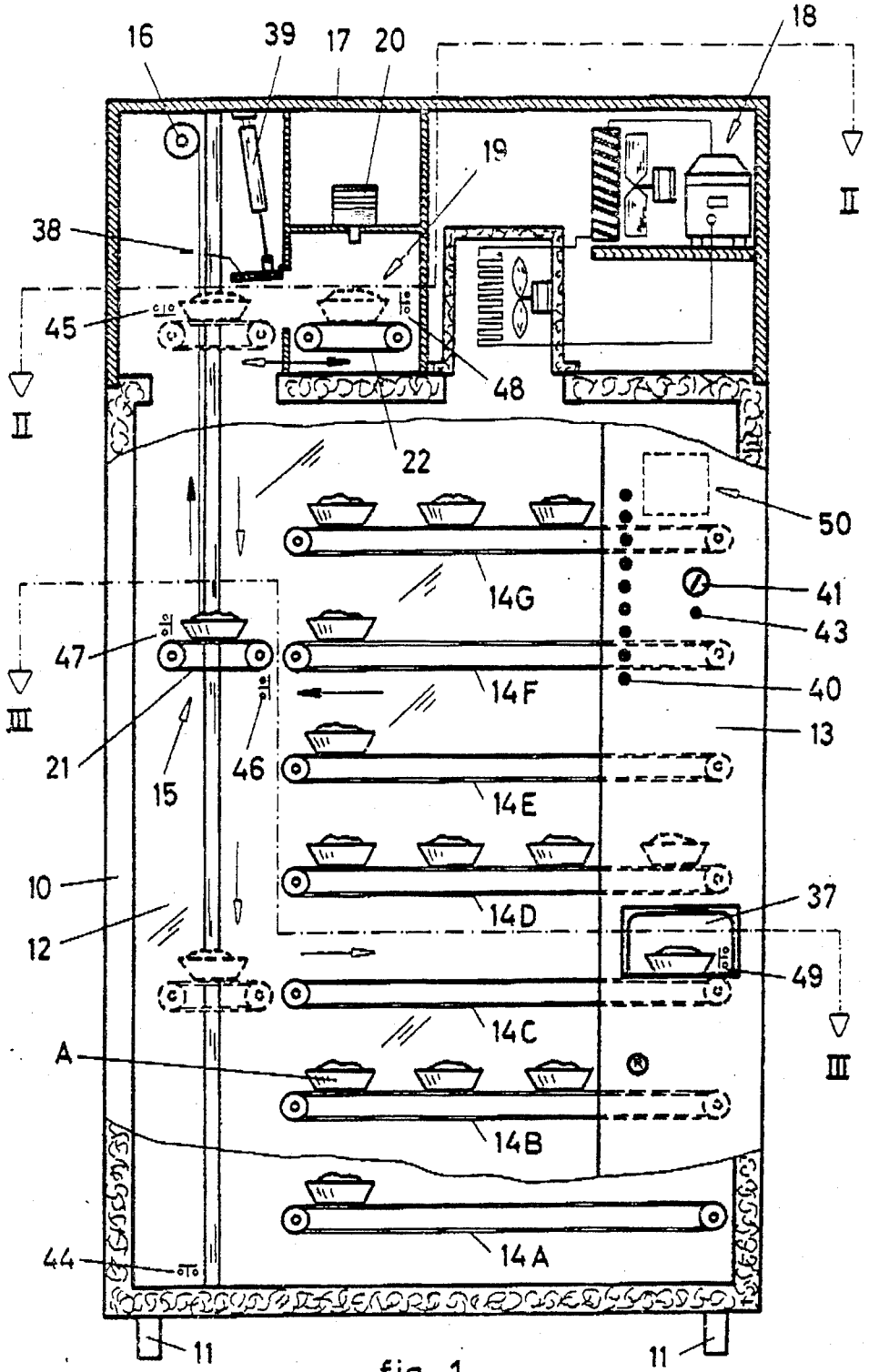
FIG. 1 is a partially stripped-off front elevation view.
Figure 2:
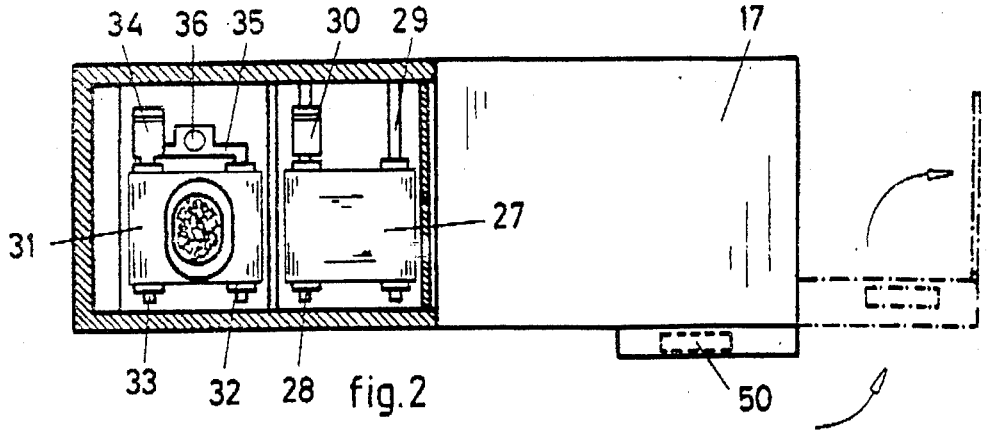
FIGS. 2 and 3 are cross-sectional views along lines II—II and III—III of FIG. 1.
Figure 3:
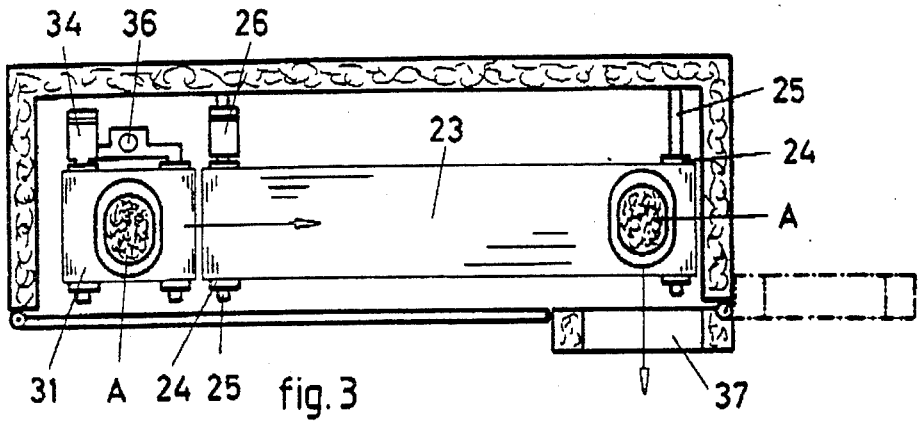
Figure 4:
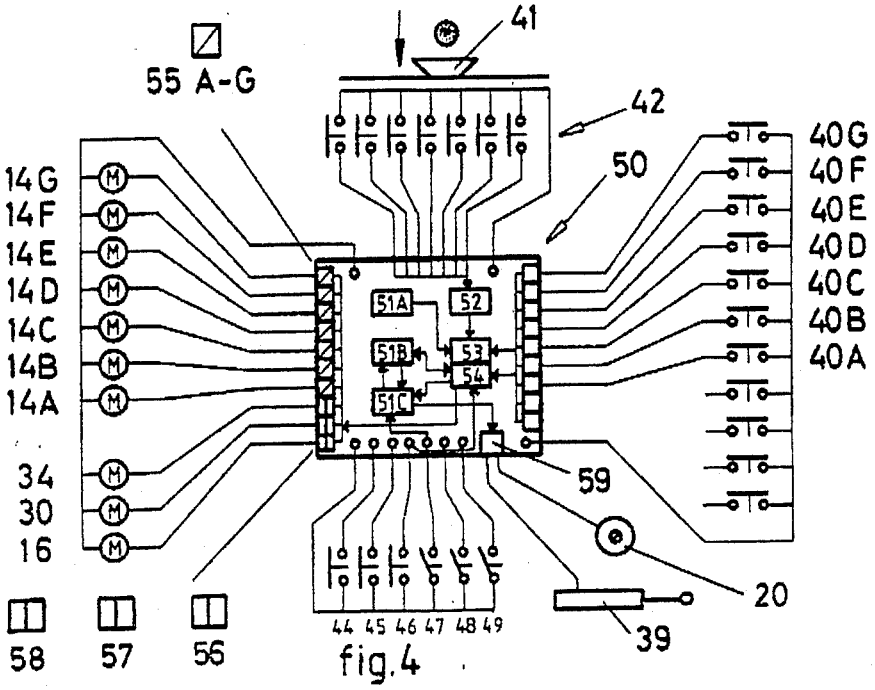
FIG. 4 shows the electrical circuit diagram.

The exemplified dispenser has the shape of an isothermal cabinet 10 provided with four legs 11, of which the front face consists of a double door composed of a transparent, relatively wide leaf 12, and a metallic, relatively thick leaf 13, housing a number of control circuits and elements.

Within the cabinet 10 are superposed seven equidistant conveyor belts 14(A,B,C,D,E,F,G) and a lift 15 driven by an electric motor 16.

Beneath a removable hood 17 capping the cabinet are housed, on one hand, a refrigerating unit 18 keeping the inside of the cabinet at a temperature close to or lower than −4 degrees C. and, on the other hand, a microwave oven 19 provided with a magnetron generator 20.

The lift 15 and the oven 19 have each a conveyor belt 21, respectively 22.

The lift 15 can stop at each of the seven floors corresponding to the seven conveyor belts 14(A,B,C,D,E,F,G) and at the floor corresponding to the conveyor belt 22.

When the dispenser is not in use, the lift 15 is stopped at the level of the conveyor belt 14 A.

The conveyor belts 14(A,B,C,D,E,F,G) are each composed of an endless belt 23 tensioned between two rolls 24 revolving around horizontal axles 25 fixed on the rear wall of the cabinet 10, one of them through a driving electric motor 26(A,B,C . . . ).

The conveyor belt 22 consists of an endless belt 27 tensioned between two rolls 28, revolving about horizontal axles 29, fixed on the rear wall of the cabinet 10, one of them through a driving electric motor 30.

The ends of the conveyor belts 14(A,B,C . . . ) and 22 situated on the side of the lift 15 are practically vertically aligned and at a small distance from the vertical trajectory of the corresponding end of belt 21.

The conveyor belt 21 consists of an endless belt 31 tensioned between two rollers 32 revolving about horizontal axles 33, one of them through a driving electric motor 34.

Said axles are fixed to a frame 35 sliding along a column 36 bearing on the bottom of the cabinet 10 and extending inside the hood 17 through a passage provided in the ceiling of the cabinet 10.

On a level with belt 14 C there is an opening 37 provided in the leaf 13. The oven enclosure 19 has a normally open wicket 38 which is controlled by an electromagnet 39.

The conveyor belts 14 A(A,B,C,D,E,F,G) form shelves whereon are aligned packaging receptacles A containing refrigerated ready-cooked food or dishes, which are to be eaten warm, for example meals consisting of meat and vegetables, or items such as hamburgers, meat or ham pastries, vegetable tarts, cheese cake, quiches lorraine, etc.

Each of these shelves carries only packaging receptacles containing identical products or of the same nature, requiring an identical heating time.

Whenever an order or selection is input to the dispenser, the belt 14 carrying the selected product starts off from the right to the left so as to bring the first packaging receptacle A in the row on the conveyor belt 21 of the lift 15 which takes it up to the level of the oven 19, into which it is introduced by the conveyor belt 22 (black arrows).

Once its contents have been heated, the packaging receptacle A is taken with a reverse motion to the level of the output belt 14 C which starts off from the left to the right so as to take the receptacle to the outlet opening 37, where it is at the consumer's disposal (white arrows).

On the front side of leaf 13 are disposed, over the opening 37, a keyboard consisting of seven vertically aligned keys 40, and a slot 41 of a coin counter 42 with its clearing key 43.

To each shelf corresponds a key 40 enabling the user to select the desired product.

The different sequences causing the displacement of a packaging receptacle A from its initial position until it arrives in front of the outlet opening 37 are controlled exclusively by electromechanical contacts, namely two end-of-travel contacts 44 and 45 of the lift 15, corresponding to the levels of belts 14 A and 22, two contacts 46 and 47 mounted on the lift 15, a contact 48 situated in the oven 19 and a contact 49 disposed near the opening 37.

Contact 46 is temporarily closed as the lift 15 is on a level with each of the different floors.

Contacts 47, 48 and 49 are operated respectively when the selected packaging receptacle A is correctly positioned on the lift 15 (both during upward and return travel), in the oven 19 and in front of the outlet opening 37.

The selection keys 40, the coin counter 42, the different motors 26(A,B,C . . . ) 30 and 34, the contacts 44 to 49, the magnetron 20 and the electromagnet 39 are connected to an electronic processor 50 controlling, in a way well known by the skilled in the art, the operation of the dispenser.

The coin counter 42 and the processor 50 are housed inside leaf 13 and can be accessed through its movable inner wall. The processor 50 comprises three memories 51 A,B,C wherein are recorded respectively the prices of the products and the floors where the products are stored, as well as their heating time, an adding-up device 52 connected to the coin counter 42, a comparator 53 which compares the amounts stored in memory 51 A and in the adding-up device 52 according to the selected product, an adding-up device 54 which counts, in connection with contact 46, the number of floors travelled by the lift 15 starting from floor 14 A, and which compares it with the number stored in memory 51 B for the selected product, relays 55(A,B,C, D,E,F,G) which respectively control the motors 16, 34 and 30, a relay 59 which controls the magnetron 20 and the electromagnet 39.

The dispenser is operated as follows:

The user selects a product by depressing a key 40, then introduces coins into the slot 41 of the coin counter 42 up to the total amount corresponding to the price of said product. Upon reaching the correct amount, comparator 52 triggers, through relay 56, the starting off of the motor 16, which causes the upward displacement of the lift 15.

When the lift 15 reaches the floor where the ordered product is stored, the adding-up device 54 causes motor 16 to stop and sets off motor 26 of the corresponding floor and motor 34 through corresponding relay 55 and relay 54.

Contact 47 causes both these motors to stop when the packaging receptacle A is correctly positioned on the lift 15.

Motor 16 then starts off again with an upward motion and contact 45 causes said motor to stop when the packaging receptacle A reaches the level of the conveyor belt 22.

At this point, motors 30 and 34, controlled by relays 57 and 58, are started off. Contact 48 causes both these motors to stop when the packaging receptacle A is correctly positioned into the oven 19.

The electromagnet 39 closes the wicket 38 while the magnetron 20, controlled through relay 59, is operated for a period of time equal to the heating time programmed for the selected product into memory 51 C.

Once the product has been heated, the electromagnet 39 raises the wicket 38. Motors 30 and 34 are then operated in a reverse motion so as to take the packaging receptacle A back on the conveyor belt 21 of the lift 15, then contact 47 causes both these motors to stop when the packaging receptacle A is correctly positioned on the lift 15.

Motor 16 of the lift 15 is then started off again for lowering the packaging receptacle A on a level with floor 14 C where it stops.

Motors 26 C and 34 are set off so as to transfer the packaging receptacle A towards the outlet opening 37. Contact 49 causes both these motors to stop when the packaging receptacle A is in front of the outlet opening 37.

Motor 16 is then started off again to take the lift 15 back to its starting position, the level of floor A.

The cycle is then completed.

If products which are to be eaten cold are as well at the consumer's disposal, the program will be modified accordingly, that is, the processor will suppress the sequences corresponding to taking and heating the product into the oven 19, so that the product is carried directly from the floor 14 where it is stored to the floor 14 C.

In an alternative embodiment, two superposed ovens can be envisaged, namely a microwave oven and an infrared oven, or both ovens can be microwave ovens or infrared ovens.

Moreover, it can be envisaged:

to place several shelves on the same level to place the lift 15 centrally in the cabinet 10 to provide an automatic shutting door in the plane of opening 37.

I claim:

1. An automatic dispenser for hot and cold food products comprising:

(a) a cabinet provided with means for cooling said cabinet, (b) a plurality of horizontal conveyor belts disposed one above another in said cabinet, each of said conveyor belts comprising end rollers, a motor for driving one of said rollers and a belt trained on said rollers, said conveyor belts having ends aligned in a vertical plane spaced from a side of said cabinet, said conveyor belts comprising a plurality of storage belts for storing products to be dispensed and one delivery belt, (c) said cabinet having a delivery door at an end of said delivery belt opposite said aligned ends, (d) an oven in said cabinet disposed above said horizontal conveyor belts, said oven having a door, controllable means for opening and closing said door and a conveyor in said oven, said conveyor comprising two end rollers, a reversible motor for driving one of said rollers and a conveyor belt trained on said rollers, an end of said belt adjacent said door being vertically aligned with said aligned ends of said horizontal conveyor belts, a lift in said cabinet disposed adjacent said aligned ends of said horizontal conveyor belts, said lift comprising vertical guide means, a frame slidable vertically on said guide means, two end rollers rotatably supported by said frame, a reversible motor for driving one of said rollers and a conveyor belt trained on said rollers, and computerized means for controlling said horizontal conveyor belts, said lift and said oven in the manner that upon a customer selecting a product to be eaten hot, said lift is positioned with its conveyor belt in alignment with the respective storage conveyor belt on which the selected product is stored, said respective storage conveyor belt and said lift conveyor belt are operated to transfer said product onto said lift, said lift is raised to the level of said oven, said lift conveyor belt and said oven conveyor belt are operated to transfer said product into said oven, said oven door is closed and said oven is turned on, after a selected time said oven is turned off, said oven door is opened, said oven conveyor belt and said lift conveyor belt are operated in reverse to transfer said now heated product onto said lift, said lift is lowered to the level of said delivery conveyor belt and said lift conveyor belt and delivery conveyor belt are operated to transfer said product to said delivery opening, and upon a customer selecting a product to be eaten cold, said lift is positioned with its conveyor belt in alignment with the respective storage conveyor belt on which the selected product is stored, said respective storage conveyor belt and said lift conveyor belt are operated to transfer said product onto said lift, said lift is brought to the level of said delivery conveyor belt and said lift conveyor belt and said delivery conveyor belt are operated to transfer said product to said delivery opening.

2. An automatic dispenser according to claim 1, in which said delivery conveyor belt is disposed at an intermediate height with storage conveyor belts both above and below said delivery conveyor belt.

3. An automatic dispenser according to claim 1, in which said cabinet has a front door disposed parallel to a plane extending through said horizontal conveyor belts, said front door comprising a wide transparent portion providing a view of said horizontal conveyor belts and said lift and a narrower opaque portion enclosing control circuits and elements.

4. An automatic dispenser according to claim 1 in which said cabinet comprises a removable hood housing said oven and said means for cooling said cabinet.

* * * * *